US006049995A

United States Patent [19]

Rogne et al.

[11] Patent Number: 6,049,995

[45] Date of Patent: Apr. 18, 2000

[54] INFRARED DRYER WITH AIR PURGE SHUTTER

[75] Inventors: Allan Wallace Rogne, Two Rivers; Jeffrey Donald Quass, Green Bay, both of Wis.

[73] Assignee: Megtec Systems, Inc., DePere, Wis.

[21] Appl. No.: 09/295,074

[22] Filed: Apr. 20, 1999

[51] Int. Cl.[7] ..... F26B 3/34

[52] U.S. Cl. ..... 34/269; 34/633; 34/641; 34/643

[58] Field of Search ..... 34/267, 268, 269, 34/420, 421, 444, 446, 619, 629, 633, 641, 643, 649, 654; 226/91, 92, 95, 97; 101/424.1, 424.2, 487, 488

[56] References Cited

U.S. PATENT DOCUMENTS

| | | | |
|---|---|---|---|
| D. 232,571 | 8/1974 | Rogne | D32/8 |
| 3,643,342 | 2/1972 | Tyson et al. | 34/48 |
| 4,756,091 | 7/1988 | Van Denend | 34/4 |
| 4,936,025 | 6/1990 | Heikkila | 34/18 |
| 5,009,016 | 4/1991 | LePisto et al. | 34/421 |
| 5,249,373 | 10/1993 | Rogne et al. | 226/92 X |
| 5,261,166 | 11/1993 | Seeley et al. | 34/1 X |
| 5,272,819 | 12/1993 | Wimberger et al. | 34/156 X |
| 5,377,428 | 1/1995 | Clark | 34/447 X |
| 5,537,925 | 7/1996 | Secor et al. | 101/424.1 |
| 5,638,611 | 6/1997 | Oeschle | 34/447 |
| 5,647,144 | 7/1997 | Bria et al. | 34/414 |
| 5,694,702 | 12/1997 | Anderson | 34/447 X |
| 5,765,294 | 6/1998 | Puschnerat | 34/421 |
| 5,867,920 | 2/1999 | Rogne et al. | 34/267 |

*Primary Examiner*—Stepen Gravini
*Attorney, Agent, or Firm*—Mitchell D. Bittman; Kevin Lemack

[57] ABSTRACT

A combination infrared/air convection dryer or oven for travelling webs. A shutter assembly is provided between the infrared radiation source and the moving web in order to selectively expose the web to infrared radiation, and to create a sealed air chamber when in the closed position. Enhanced drying of the web and/or a coating on the web at high speed is achieved without a concomitant increase in dryer length. When the drying atmosphere has a high concentration of solvent, exposure of that atmosphere to the heating elements, which can cause explosions, is eliminated by actuation of the shutters. In a preferred embodiment of the invention, air bars are used to floatingly support the moving web to avoid contact of the web with dryer elements.

8 Claims, 8 Drawing Sheets

INFRARED DRYER WITH AIR PURGE SHUTTER

BACKGROUND OF THE INVENTION

The present invention relates to web drying apparatus. In drying a moving web of material, such as paper, film or other sheet or planar material, it is often desirable that the web be dried quickly, and that the length of the dryer be limited in view of space and cost constraints. Various attempts have been made in the prior art for decreasing the length and/or increasing the efficiency and line speed of web dryers. To that end, infrared radiation has been used either alone or in combination with air to dry the web. For example, U.S. Pat. No. 4,936,025 discloses a method for drying a moving web by passing the web free of contact through various drying gaps. Thus, the web is passed through an infrared treatment gap in which infrared radiation is applied to the web from an infrared unit, and then is passed into an air-drying gap within which the web is dried by gas blowings from an airborne web dryer unit which simultaneously supports the web free of contact. Further, U.S. Pat. No. 4,756,091 discloses a hybrid gas-heated air and infrared radiation drying oven in which strips of infrared heaters are arranged with heated air inflow nozzles alongside thereof. U.S. Pat. No. 5,261,166 discloses a combination infrared and air flotation dryer wherein a plurality of air bars are mounted above and below the web for contactless convection drying of the web, and a plurality of infrared gas fired burners are mounted between air bars.

In many conventional infrared dryers, however, much of the heat supplied by the infrared energy source is lost to surroundings by transmission, reflection and radiation. In addition, the infrared elements must be continually turned on and off to avoid burning of the web. This reduces efficiency and can reduce infrared element life. Also, if dryer atmosphere with high solvent concentrations comes into contact with the hot infrared heating elements, explosion could result.

It is therefore an object of the present invention to provide a more efficient combination infrared/air flotation dryer for drying moving webs.

It is a further object of the present invention to provide optimal control of an infrared/air flotation dryer.

It is a still further object of the present invention to provide infrared and air drying while floatingly supporting the moving web.

It is another object of the present invention to eliminate the need to continually turn the infrared elements on and off during the drying operation without sacrificing safety.

It is a further object of the present invention to prevent a potentially explosive dryer atmosphere from contacting the high temperature heating surface in the dryer.

SUMMARY OF THE INVENTION

The problems of the prior art have been overcome by the present invention, which provides a combination infrared/air convection dryer or oven for travelling webs. A shutter assembly is provided between the infrared radiation source and the moving web in order to selectively expose the web to infrared radiation, and to create a sealed air chamber when in the closed position. Enhanced drying of the web and/or a coating on the web at high speed is achieved without a concomitant increase in dryer length. When the drying atmosphere has a high concentration of solvent, exposure of that atmosphere to the heating elements, which can cause explosions, is eliminated by actuation of the shutters and opening of the air purge volume control damper. In a preferred embodiment of the invention, air bars are used to floatingly support the moving web to avoid contact of the web with dryer elements.

DETAILED DESCRIPTION OF THE INVENTION

Figure 1:
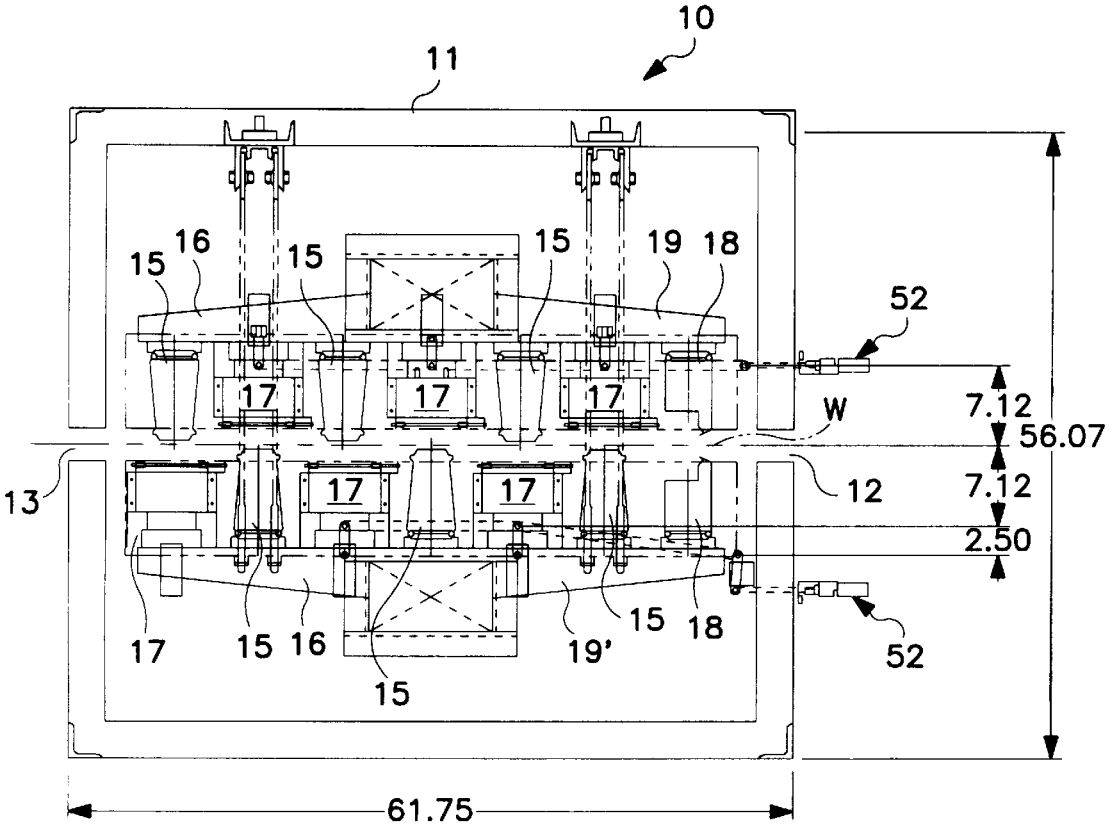
FIG. 1 is a front view of the web dryer in accordance with the present invention.

Turning first to FIG. 1, there is shown generally at 10 a dryer or oven in accordance with the present invention. The dryer 10 is defined by a housing 11, preferably insulated, having a web inlet opening 12 to accommodate entry of a web W into the housing and a web outlet opening 13 spaced from the inlet 12 to accommodate exit of the web W from the housing, as shown. The housing 11 can be constructed of any suitable material, such as aluminum or steel.

A plurality of air bars 15 are positioned above and below the web W in air receiving communication with suitable ductwork 19, 19' to supply heated air (such as via a fan, not shown) to provide air impingement to the web W. Preferably the air bars 15 are air flotation bars such as HI-FLOAT® air bars commercially available from MEGTEC Systems, which both floatingly support and dry the moving web. The positioning of the air bars 15 is not particularly limited, although the arrangement shown is preferred. Specifically, it is preferred that each air bar above the web W (as the dryer is oriented in FIG. 1) oppose an infrared heating element 17 below the web W, and that opposing air knives 18 be positioned at the web entry side, web exit side or both ends of the dryer 10. This arrangement also places an infrared heating element 17 between each air bar 15 in the assemblies above and below the web W. The air bars 15 emit impingement air to both floatingly support and dry the web, preferably utilizing the Coanda effect for optimal drying. Those skilled in the art will appreciate that the infrared radiation sources can be used above the web, below the web, or both, depending upon the drying capacity desired. Quartz infrared heating elements are particularly preferred.

Figure 2:
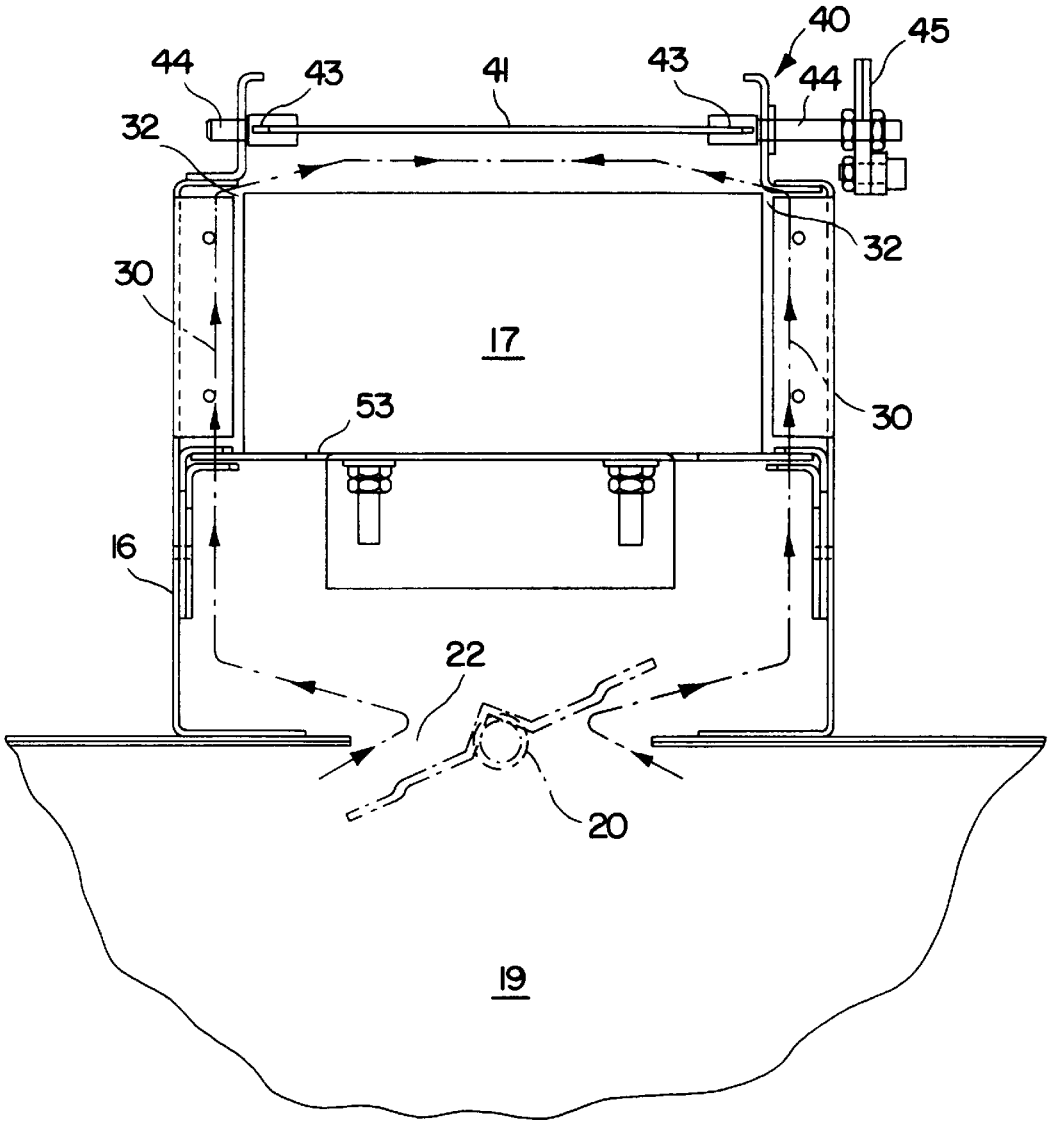
FIG. 2 is an end view of the infrared heating element and shutter assembly for use in the dryer of the present invention.

Turning now to FIG. 2, each infrared heating element 17 is mounted in air receiving communication with air supply duct 16 that in turn is in communication with a main air supply chamber 19. Volume control damper 20 is positioned at the inlet 22 of the supply duct 16 to modulate the flow of air from the air supply chamber 19 into the supply duct 16.

Figure 6:
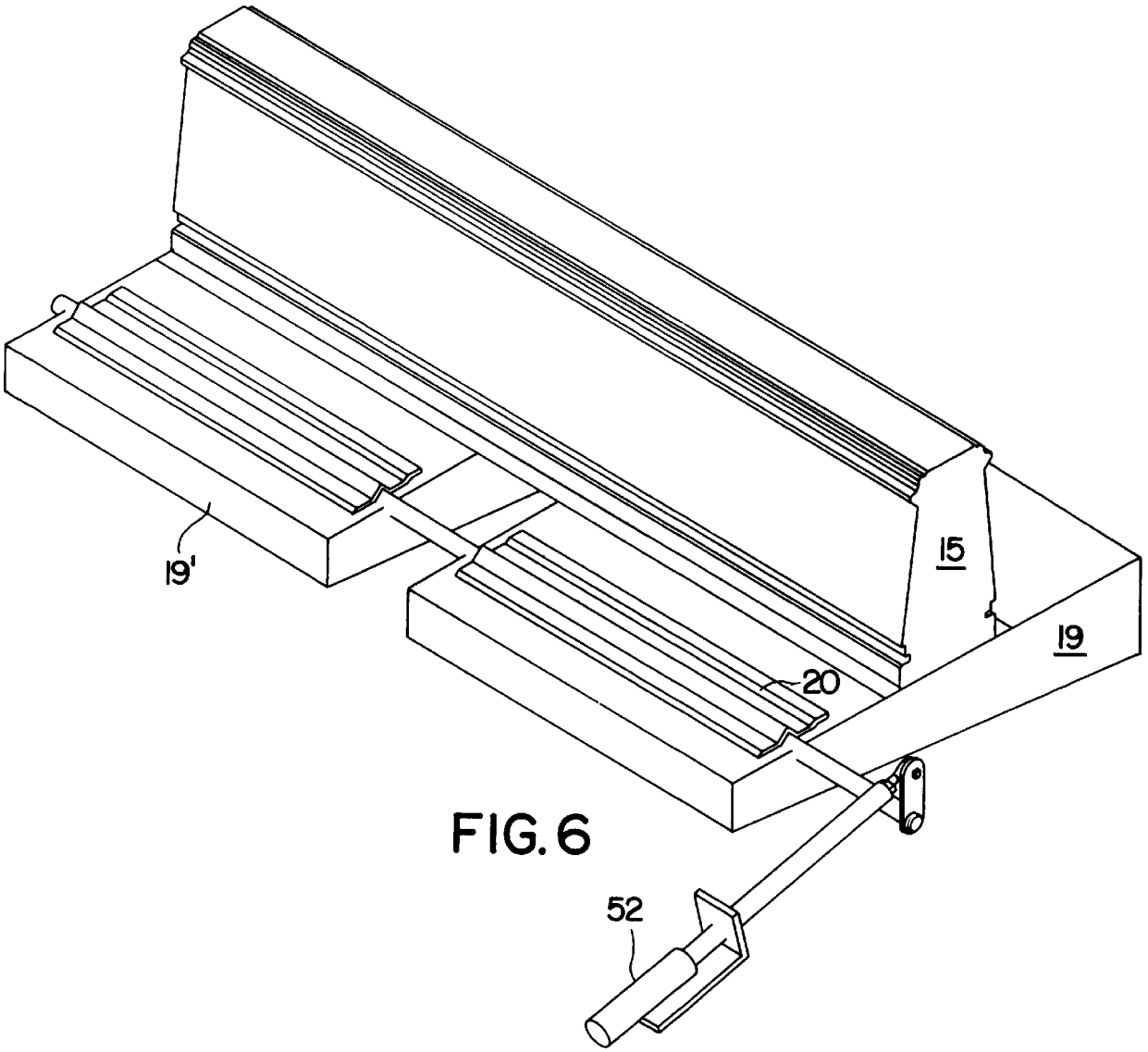
FIG. 6 is a cut-away perspective view of the volume control damper in the closed position.
Figure 7:
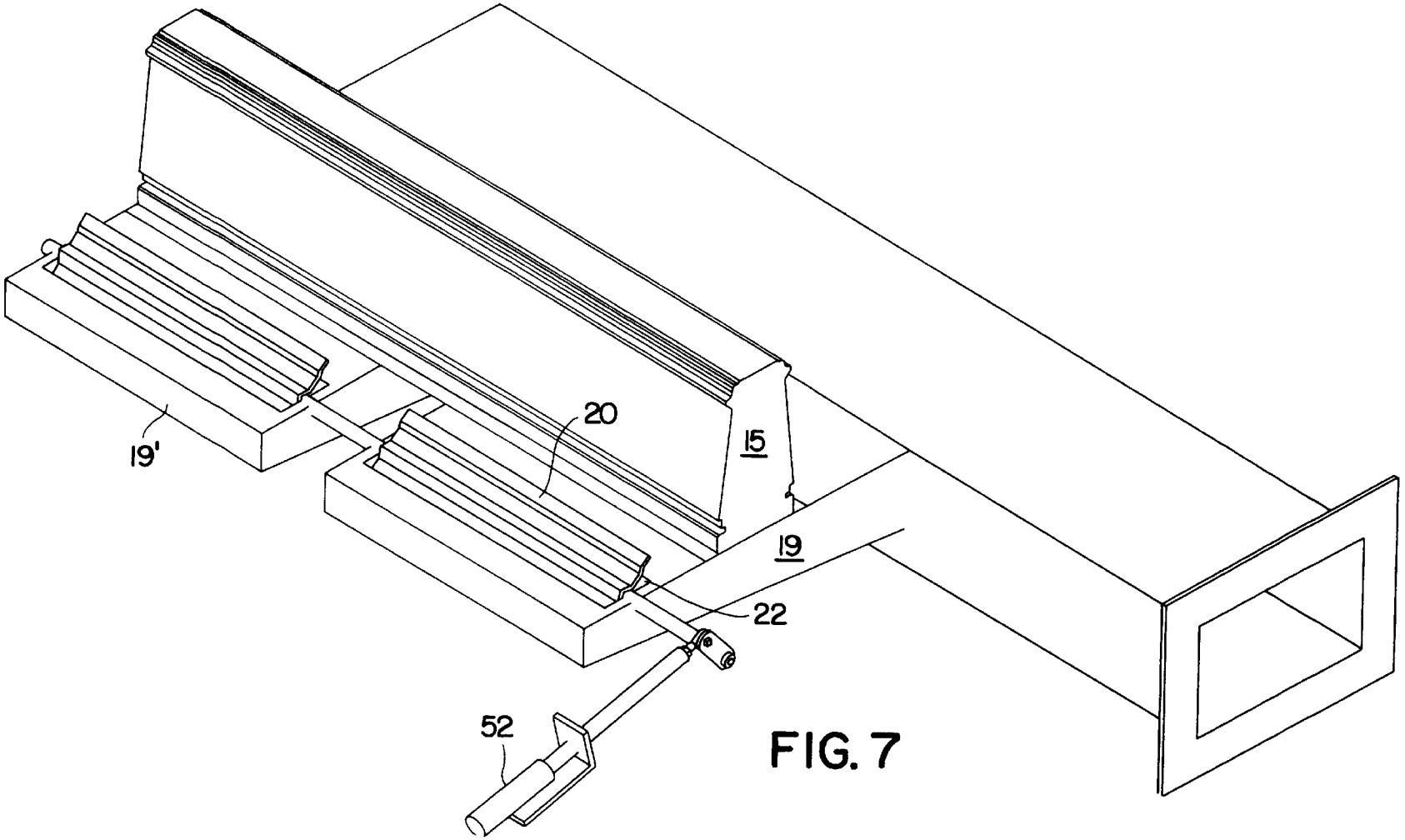
FIG. 7 is a cut-away perspective view of the volume control damper in the open position.

When the damper 20 is open (FIG. 7), air then flows past infrared heating element 17 through an air distribution duct 30, and is finally exhausted through air jets 32 as shown by the broken lines in FIG. 2. When the damper 20 is closed (FIG. 6), air flow past the element 17 is stopped.

Figure 3:
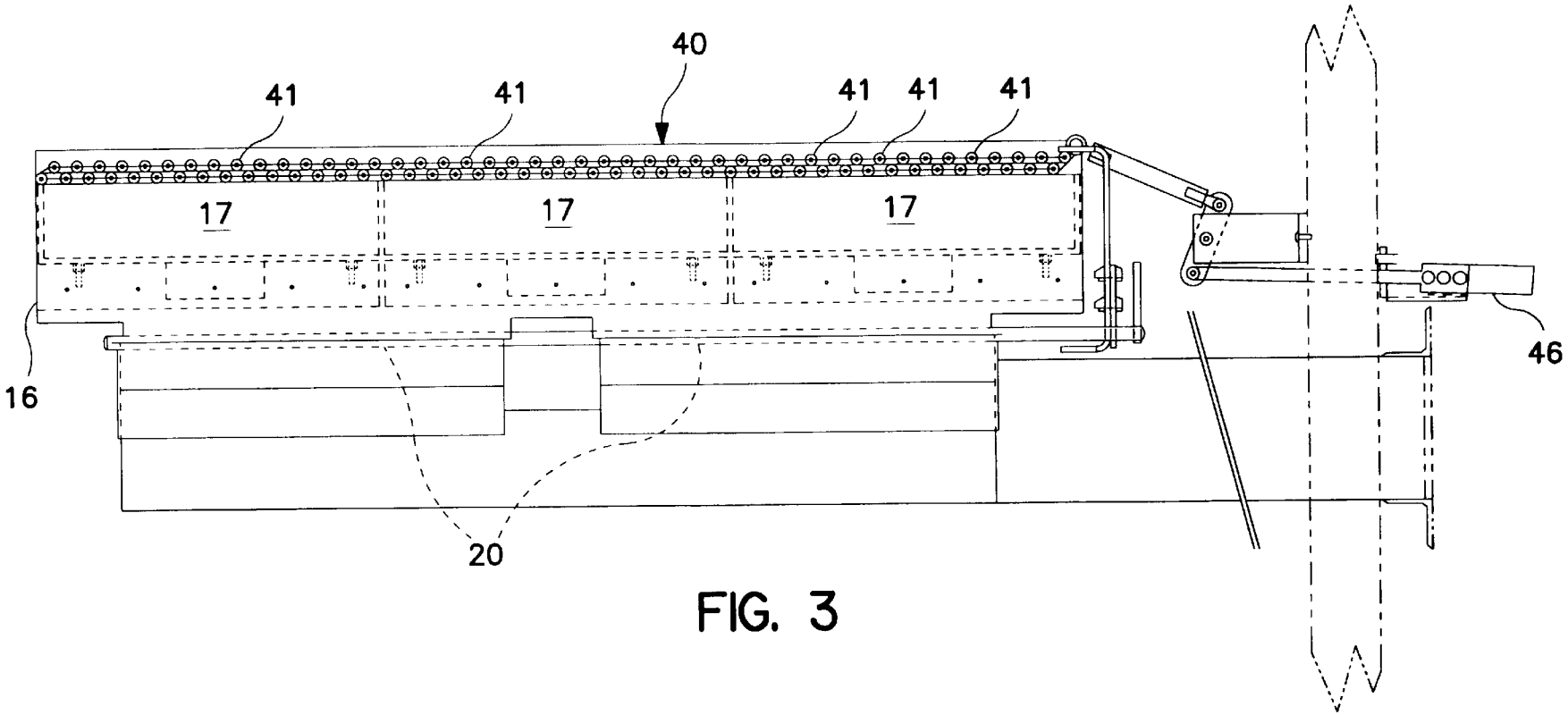
FIG. 3 is a side view of the infrared heating element and shutter assembly for use in the dryer of the present invention.
Figure 4:
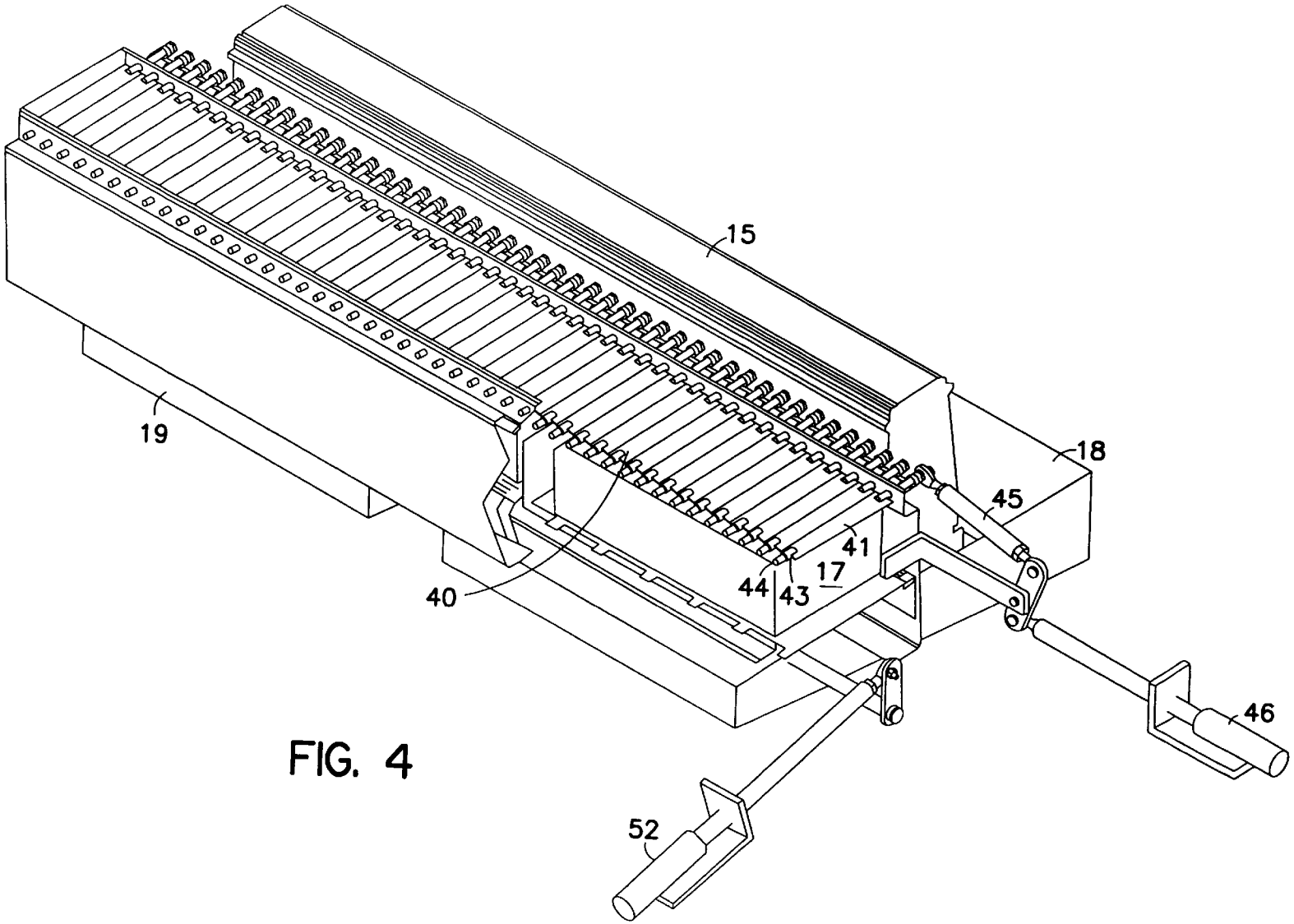
FIG. 4 is a perspective view of the infrared heating element with the shutter assembly in the closed position.
Figure 5:
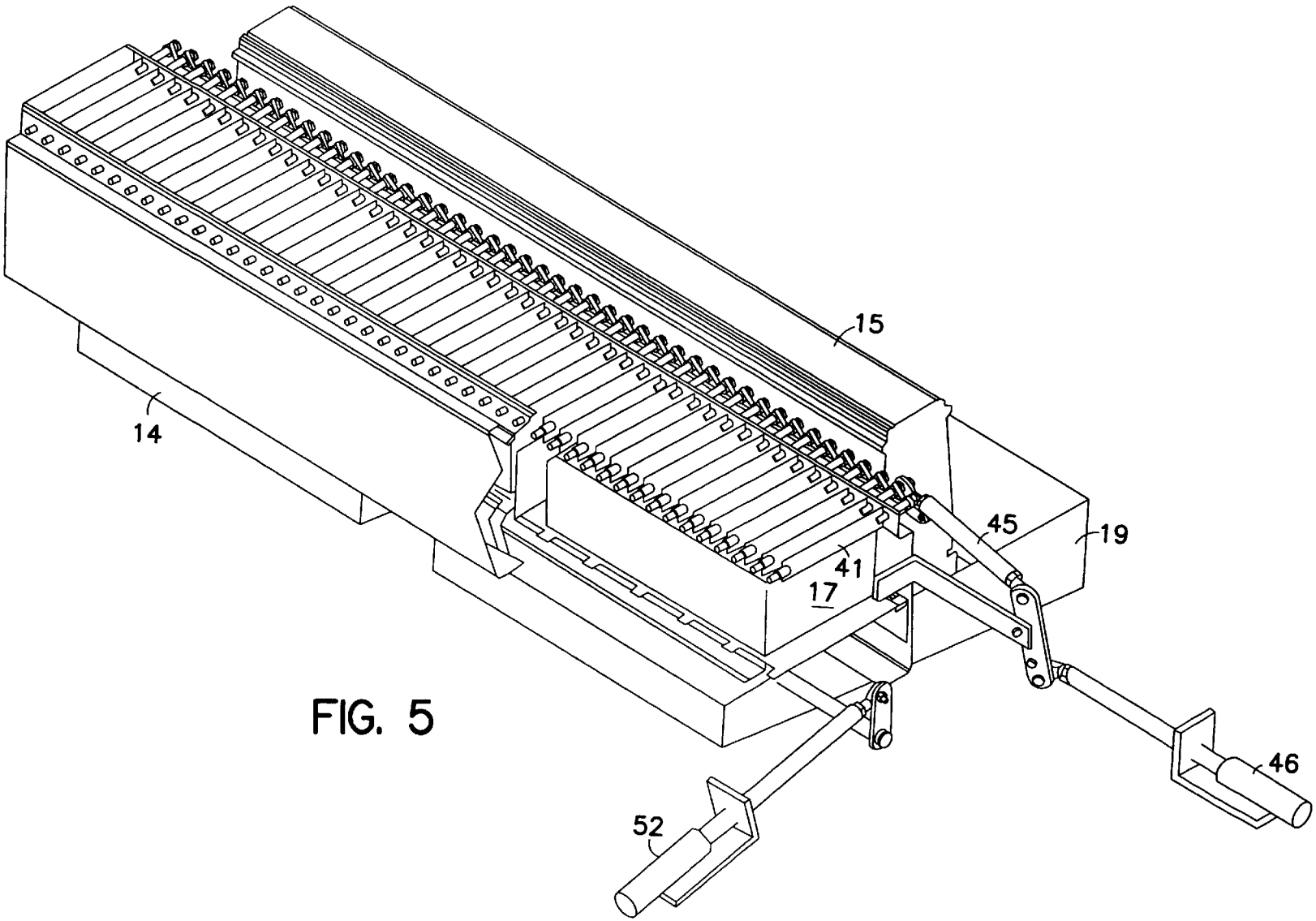
FIG. 5 is a perspective view of the infrared heating element with the shutter assembly in the open position.

A shutter assembly 40 comprising a plurality of juxtaposed shutter blades 41 is mounted on top of the air distribution duct 30, and is positioned between each infrared heating element 17 and the web W, as shown in FIGS. 2 and 3. The shutter blades 41 allow for control of the radiation permitted to reach the web W without the necessity of turning off the infrared radiation source(s). Each shutter assembly 40 includes a plurality of aligned blades 41, each blade 41 slightly overlapping its adjacent blade when in the closed position, as best seen in FIGS. 3 and 4. The number of blades 41 in each shutter assembly can vary, and depends on the particular dimensions of the infrared heating element being used. Although the dimensions of each blade are not critical, is has been found that blades 1 inch wide are suitable, and that such blades can be placed 0.94 inches center-to-center to create the necessary overlap. Preferably the blades 41 are designed with a reflecting surface to reflect the infrared light back towards the infrared elements and direct it way from the web W. The blades 41 are attached to the shutter assembly using a pin arrangement as shown. Thus, each end of each blade 41 is pivotally affixed into a slot 43 on the end of pin 44. The end of one pin 44 opposite slot 43 is affixed to shutter control linkage 45, which allows all of the blades to be pivoted simultaneously upon actuation of external air cylinder 46 (FIGS. 3–5).

Figure 8:
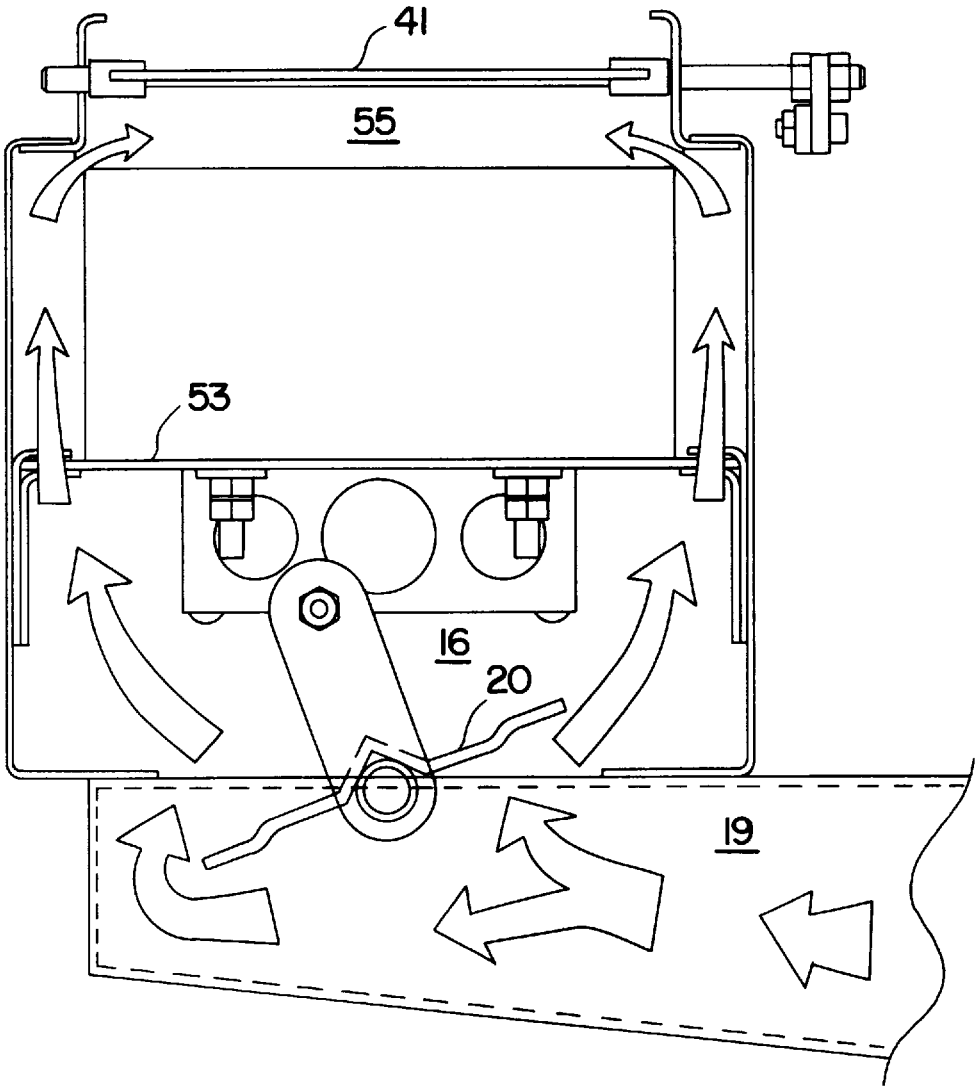
FIG. 8 is an end view of the infrared heating element showing the direction of air flow in accordance with one embodiment of the present invention.

The shutter assembly 40 also serves an air purge function. In anticipation of a high dryer LEL atmosphere, or in response to a measured solvent concentration with a conventional LEL monitor, the shutter 40 is signaled to move to a closed position, and the volume control damper 20 is signaled to move to an open position. Opening damper 20 (such as manually or preferably with air cylinder 52) allows pressurized air to flow into the supply duct 16 underneath heating element 17, and the air is then evenly exhausted out of control nozzle jets 32 arranged evenly around the entire perimeter of each infrared heating element. Since the shutter assembly 40 is closed, a pressurized chamber is created directly above the hot infrared element. Clearances between blades 41 in shutter assembly 40 allow air to leak out from the pressurized chamber, but prevent the solvent-laden air from leaking into the chamber and contacting the hot element 17. Actual measurement of the concentration of solvent in the dryer atmosphere can be carried out by conventional means well known to those skilled in the art. Actuation of the volume control damper 20 and shutter assembly 40 are coordinated with an electrical interlock control, and can be responsive to the measured solvent concentration. The arrows in FIG. 8 depict this situation; air flows past damper 20 and up through the infrared element mounting bracket 53 which is perforated at its side edges, out air jets 32 into compartment 55 formed between the underside of the shutters 41 and the IR heating element. Since only a small portion of this air leaks through the shutters 41, a pressurized chamber is formed, helping to prevent solvent-laden air from entering the chamber and contacting the hot IR element.

For example, solvent concentration in the dryer enclosure can be sensed with a suitable monitor. When the solvent concentration exceeds a predetermined level, the shutters 41 are signaled to close and the volume damper 20 is signaled to open simultaneously. This prevents the high solvent concentration air from directly contacting the heating elements and cause an explosive condition. Alternatively, instead of directly monitoring solvent concentration, the actuation of the shutters and damper can be based on a predetermined cycle in the drying process, such as the initiation of a printing press blanket wash cycle.

In another embodiment of the present invention, it can be advantageous to maintain a continuous air purge to dilute the LEL concentration on the face of the heating elements 17 during the drying mode when the shutter assembly 40 is open. In this case, the volume control damper 20 is continuously open to allow the air jets 32 to distribute fresh air on the surface of the heating elements 17, even when the shutter assembly 40 is open.

What is claimed is:

1. A dryer for a moving web, comprising:

a dryer enclosure having a web inlet slot and a web outlet slot spaced from said web inlet slot;

impingement means in said enclosure for causing gas to impinge upon said web;

gas supply means in communication with said impingement means for supplying said gas to said impingement means;

infrared heating means in said enclosure for irradiating infrared light and heating said web;

shutter means in said enclosure, said shutter means being moveable between a first open position allowing said irradiated infrared light to impinge upon said web and a second closed position preventing said irradiated infrared light from impinging upon said web; and damper means in said enclosure for controlling the flow of gas about said infrared heating means.

2. The dryer of claim 1, wherein the opening of said damper means is coordinated with the closing of said shutter means.

3. The dryer of claim 1, wherein said impingement means comprises a plurality of air nozzles.

4. The dryer of claim 1, wherein said impingement means comprises a plurality of flotation nozzles for floating supporting said web.

5. The dryer of claim 1, wherein the opening and closing of said shutter means is responsive to the concentration of solvent in the dryer atmosphere.

6. A dryer for drying a running web, comprising:

a dryer housing having a web inlet slot and a web outlet slot spaced from said web inlet slot and having a dryer atmosphere;

impingement means in said housing for causing gas to impinge upon said web;

a fan in communication with said impingement means for supplying said gas to said impingement means;

infrared heating means in said housing for irradiating infrared light and heating said web;

means for measuring the concentration of volatile solvent in said dryer atmosphere;

shutter means in said housing responsive to said measured concentration of volatile solvent for blocking the flow of said volatile solvent from contacting said infrared heating means.

7. The dryer of claim 6, wherein said infrared heating means are in communication with a supply gas, and wherein said dryer further comprises a damper for controlling the supply of gas about said infrared heating means.

8. The dryer of claim 7, wherein movement of said damper and of said shutter means are coordinated.

* * * * *